US011518585B2

(12) United States Patent
Jinkins et al.

(10) Patent No.: US 11,518,585 B2
(45) Date of Patent: Dec. 6, 2022

(54) CLOSURE AND LID AND METHOD OF FORMING CLOSURE AND LID

(71) Applicant: YETI Coolers, LLC, Austin, TX (US)

(72) Inventors: Cody Jinkins, Austin, TX (US); Andy Bondhus, Austin, TX (US); Mark Carlson Rane, Austin, TX (US); Dustin Bullock, Austin, TX (US); John Fritz, Austin, TX (US)

(73) Assignee: YETI Coolers, LLC, Austin, TX (US)

( * ) Notice: Subject to any disclaimer, the term of this patent is extended or adjusted under 35 U.S.C. 154(b) by 0 days.

(21) Appl. No.: 17/288,067

(22) PCT Filed: Oct. 22, 2019

(86) PCT No.: PCT/US2019/057420
§ 371 (c)(1),
(2) Date: Apr. 23, 2021

(87) PCT Pub. No.: WO2020/086567
PCT Pub. Date: Apr. 30, 2020

(65) Prior Publication Data

US 2021/0378428 A1 Dec. 9, 2021

Related U.S. Application Data

(60) Provisional application No. 62/749,443, filed on Oct. 23, 2018.

(51) Int. Cl.
*B65D 47/28* (2006.01)
*B65D 41/16* (2006.01)
(Continued)

(52) U.S. Cl.
CPC ..... *B65D 47/286* (2013.01); *A47G 19/2272* (2013.01); *B65D 41/16* (2013.01); *B65D 53/02* (2013.01)

(58) Field of Classification Search
CPC .. A47G 19/2272; B65D 47/12; B65D 47/286; B65D 47/26; B65D 47/28;
(Continued)

(56) References Cited

U.S. PATENT DOCUMENTS 2,304,214 A 12/1942 Straub
D255,858 S 7/1980 Ashton
(Continued)

FOREIGN PATENT DOCUMENTS

CA 2534232 A1 * 2/2005
CN 101037153 A 9/2007
(Continued)

OTHER PUBLICATIONS

Feb. 6, 2020—(WO) International Search Report & Written Opinion—PCT/US19/057420.
(Continued)

*Primary Examiner* — Allan D Stevens
(74) *Attorney, Agent, or Firm* — Banner & Witcoff, Ltd.

(57) ABSTRACT

An example lid assembly can include a lid and a slider. The lid can include a wall defining a recess. The slider can be configured to slide in the recess and can be configured to move between a closed position where the slider covers the opening to aid in preventing spilling of contents of the container and an opened position where the slider uncovers the opening such that the contents of the container can be consumed. The slider can be configured to be removable from the lid and can be replaced back on the lid. Additionally, the slider can be formed from upper and lower sled elements that are magnetically coupled to one another.

27 Claims, 14 Drawing Sheets

(51) Int. Cl.
*B65D 53/02* (2006.01)
*A47G 19/22* (2006.01)

(58) Field of Classification Search
CPC .... B65D 2251/0025; B65D 2251/0081; B65D 51/18; B65D 43/20; B65D 43/12; B65D 41/62; B65D 2543/00046; B65D 2543/0025
USPC ..... 220/230, 254.9
See application file for complete search history.

(56) References Cited

U.S. PATENT DOCUMENTS

| | | | | |
|---|---|---|---|---|
| 4,746,032 | A * | 5/1988 | Huang | B65D 17/506 220/255 |
| 4,819,829 | A * | 4/1989 | Rosten | B65D 5/727 220/345.3 |
| 5,208,951 | A | 5/1993 | Aoki | |
| D362,369 | S | 9/1995 | Bridges | |
| 5,462,189 | A | 10/1995 | Pierce | |
| D417,365 | S | 12/1999 | Huang | |
| D427,853 | S | 7/2000 | Kohlhase | |
| D458,082 | S | 6/2002 | Gluck | |
| D481,590 | S | 11/2003 | Lin | |
| D482,238 | S | 11/2003 | Lin | |
| D486,997 | S | 2/2004 | Janky | |
| 6,752,287 | B1 | 6/2004 | Lin | |
| D511,653 | S | 11/2005 | Oas | |
| D533,402 | S | 12/2006 | Bin | |
| D558,523 | S | 1/2008 | Bhavnani | |
| D571,152 | S | 6/2008 | Tien | |
| 7,513,380 | B2 | 4/2009 | Canedo | |
| D609,054 | S | 2/2010 | Gilbert | |
| D616,248 | S | 5/2010 | George | |
| 7,950,541 | B2 | 5/2011 | Holcomb et al. | |
| D659,474 | S | 5/2012 | Wahl et al. | |
| 8,484,809 | B2 | 7/2013 | Fiedler | |
| 8,495,803 | B2 | 7/2013 | Fiedler | |
| 8,636,167 | B2 | 1/2014 | Hajichristou et al. | |
| 9,096,148 | B2 | 8/2015 | Fiedler | |
| D744,286 | S | 12/2015 | Morris, II et al. | |
| D751,338 | S | 3/2016 | Seiders et al. | |
| D751,339 | S | 3/2016 | Seiders et al. | |
| D761,619 | S | 7/2016 | Seiders et al. | |
| D790,272 | S | 6/2017 | Han | |
| D797,510 | S | 9/2017 | Ke | |
| 9,782,029 | B1 | 10/2017 | FitzSimons | |
| D801,746 | S | 11/2017 | Thuma et al. | |
| D802,362 | S | 11/2017 | Spivey et al. | |
| 9,815,076 | B2 | 11/2017 | Schulz et al. | |
| 9,845,181 | B2 | 12/2017 | Abraham | |
| D808,722 | S | 1/2018 | Hill | |
| D810,511 | S | 2/2018 | Harrington, III et al. | |
| 9,889,968 | B2 | 2/2018 | Morewitz et al. | |
| D811,817 | S | 3/2018 | Harrington, III et al. | |
| D814,870 | S | 4/2018 | Spivey et al. | |
| D815,893 | S | 4/2018 | Seiders et al. | |
| D819,406 | S | 6/2018 | Rivera | |
| D820,045 | S | 6/2018 | Harrington, III et al. | |
| D822,440 | S | 7/2018 | Kuh et al. | |
| 10,026,535 | B2 | 7/2018 | Bohannon | |
| D830,127 | S | 10/2018 | Rohe | |
| D833,817 | S | 11/2018 | Sletten | |
| 10,124,942 | B2 * | 11/2018 | Seiders | B29C 45/1657 |
| D842,028 | S | 3/2019 | Melanson et al. | |
| 10,232,992 | B2 | 3/2019 | Seiders et al. | |
| 10,232,993 | B2 * | 3/2019 | Seiders | B65D 47/286 |
| D850,191 | S | 6/2019 | Jacobsen | |
| D850,192 | S | 6/2019 | Jacobsen | |
| 10,329,070 | B2 | 6/2019 | Wengerd | |
| D867,057 | S | 11/2019 | Spivey et al. | |
| 10,486,868 | B2 | 11/2019 | Spivey et al. | |
| D871,149 | S | 12/2019 | Kaiser | |
| D875,471 | S | 2/2020 | Cheng et al. | |
| D882,343 | S | 4/2020 | Rane et al. | |
| D886,526 | S | 6/2020 | Seiders et al. | |
| 10,689,166 | B1 | 6/2020 | Cheng | |
| D890,573 | S | 7/2020 | Jacobsen | |
| D891,182 | S | 7/2020 | Lane et al. | |
| D895,370 | S | 9/2020 | Hamilton | |
| D899,191 | S | 10/2020 | Jacobsen | |
| D899,857 | S | 10/2020 | Jacobsen | |
| D899,858 | S | 10/2020 | Jacobsen | |
| D899,862 | S | 10/2020 | Rane et al. | |
| 10,791,858 | B2 | 10/2020 | Robertson | |
| D904,125 | S | 12/2020 | Jacobsen | |
| 10,870,522 | B2 | 12/2020 | Lane | |
| D909,818 | S | 2/2021 | Hunter et al. | |
| D911,779 | S | 3/2021 | Hunter et al. | |
| D915,827 | S | 4/2021 | Fang | |
| D917,970 | S | 5/2021 | Bullock et al. | |
| 2007/0170184 | A1 | 7/2007 | Canedo | |
| 2008/0006643 | A1 * | 1/2008 | Ma | A47J 41/0011 220/592.16 |
| 2014/0034080 | A1 | 2/2014 | Paquet et al. | |
| 2015/0191293 | A1 | 7/2015 | Forcella | |
| 2015/0329250 | A1 | 11/2015 | Barreto et al. | |
| 2016/0272384 | A1 | 9/2016 | Lee et al. | |
| 2017/0066573 | A1 | 3/2017 | Karussi et al. | |
| 2017/0121072 | A1 | 5/2017 | Seiders et al. | |
| 2018/0127165 | A1 | 5/2018 | Smaldone et al. | |
| 2018/0140120 | A1 | 5/2018 | Shackelford | |
| 2019/0125111 | A1 | 5/2019 | Morewitz et al. | |
| 2019/0152661 | A1 | 5/2019 | Seiders et al. | |
| 2020/0055645 | A1 | 2/2020 | Lane | |
| 2020/0231345 | A1 | 7/2020 | Lane et al. | |
| 2020/0331671 | A1 | 10/2020 | Seiders et al. | |
| 2020/0361672 | A1 | 11/2020 | Jinkins et al. | |
| 2020/0377272 | A1 | 12/2020 | Ma et al. | |
| 2020/0377273 | A1 | 12/2020 | Seiders et al. | |
| 2020/0391910 | A1 | 12/2020 | Pinelli et al. | |
| 2021/0047089 | A1 | 2/2021 | Seiders et al. | |
| 2022/0033139 | A1 * | 2/2022 | Bühler | B65D 17/506 |
| 2022/0087454 | A1 * | 3/2022 | Meyers | B65D 47/286 |

FOREIGN PATENT DOCUMENTS

| | | | |
|---|---|---|---|
| CN | 300794415 | | 6/2008 |
| CN | 103654438 | A | 3/2014 |
| CN | 201330396737.6 | | 3/2014 |
| CN | 201330642776.X | | 10/2014 |
| CN | 303652430 | | 11/2015 |
| CN | 206342283 | U | 7/2017 |
| CN | 20730651 | U | 5/2018 |
| CN | 207383540 | U | 5/2018 |
| CN | 108471891 | A | 8/2018 |
| CN | 207886064 | U | 9/2018 |
| CN | 208808068 | U | 5/2019 |
| CN | 208851116 | U | 5/2019 |
| CN | 209058675 | U | 7/2019 |
| CN | 210300507 | U | 4/2020 |
| CN | 111109981 | A | 5/2020 |
| CN | 210643564 | U | 6/2020 |
| CN | 305962065 | S | 8/2020 |
| CN | 305978193 | S | 8/2020 |
| CN | 305993997 | S | 8/2020 |
| CN | 306016664 | S | 8/2020 |
| CN | 306016768 | S | 8/2020 |
| CN | 306031191 | S | 9/2020 |
| CN | 211748590 | U | 10/2020 |
| CN | 306090110 | | 10/2020 |
| CN | 306090181 | S | 10/2020 |
| CN | 212015230 | U | 11/2020 |
| CN | 306186561 | S | 11/2020 |
| CN | 306186641 | S | 11/2020 |
| CN | 306186797 | S | 11/2020 |
| CN | 306186841 | S | 11/2020 |
| CN | 306214271 | S | 12/2020 |
| CN | 306259892 | S | 1/2021 |
| CN | 212489438 | U | 2/2021 |
| CN | 212574644 | U | 2/2021 |
| CN | 112450686 | A | 3/2021 |
| CN | 306378710 | S | 3/2021 |
| CN | 212912633 | U | 4/2021 |

(56) References Cited

FOREIGN PATENT DOCUMENTS

| | | | |
|---|---|---|---|
| CN | 306448224 | S | 4/2021 |
| CN | 306457158 | S | 4/2021 |
| CN | 306474585 | S | 4/2021 |
| DE | 102013000557 | A1 | 7/2014 |
| EM | 508177422-0001 | | 9/2020 |
| EM | 006354742-0002 | | 10/2020 |
| EM | 308317929-0002 | | 12/2020 |
| EM | 308317929-0003 | | 12/2020 |
| EM | 308317929-0004 | | 12/2020 |
| EM | 308317929-0005 | | 12/2020 |
| EM | 308317929-0006 | | 12/2020 |
| EM | 007787692-0001 | | 1/2021 |
| EP | 3367850 | A1 | 9/2018 |
| EP | 3537936 | A1 | 9/2019 |
| EP | 308317929-0001 | | 12/2020 |
| GB | 3109996 | | 12/2020 |
| GB | 3109997 | | 12/2020 |
| GB | 6109998 | | 12/2020 |
| GB | 6109999 | | 12/2020 |
| GB | 6110000 | | 12/2020 |
| GB | 6110001 | | 12/2020 |
| GB | 0008317929-0001 | | 12/2020 |
| GB | 9008317929-0002 | | 12/2020 |
| GB | 9008317929-0003 | | 12/2020 |
| GB | 9008317929-0004 | | 12/2020 |
| GB | 9008317929-0005 | | 12/2020 |
| GB | 9008317929-0006 | | 12/2020 |
| IN | 314443-001-0001 | | 12/2020 |
| JP | 1507225 | | 9/2014 |
| JP | 2017124307 | A | 7/2017 |
| JP | D1675520 | | 1/2021 |
| JP | D1680040 | | 3/2021 |
| KR | 300953895.0000 | | 4/2018 |
| KR | 301045998 | | 2/2020 |
| KR | 301077462.0000 | | 10/2020 |
| KR | 301077816.0000 | | 10/2020 |
| KR | 3010887860001 | | 12/2020 |
| KR | 3010887860002 | | 12/2020 |
| KR | 3010887860003 | | 12/2020 |
| KR | 301100973.0000 | | 3/2021 |
| WO | 20047730 | A1 | 1/2004 |
| WO | 20086567 | A1 | 1/2008 |
| WO | 14040211 | A1 | 3/2014 |
| WO | WO-2017075482 | A1 * | 5/2017 ..... A47G 19/2272 |
| WO | 2020086567 | A1 | 4/2020 |

OTHER PUBLICATIONS

Nov. 2, 2021—(WO) International Search Report & Written Opinion—PCT/US21/030256.

Jan. 30, 2022—(CN) First Office Action—App. No. 201980070432.0.

Mar. 3, 20221 - (AU) Examination Report No. 1 - App. No. 2019368252 (008117.04796).

Jun. 22, 2022—(JP) Office Action—App. No. 2021-522098.

Jul. 27, 2022—(CA) Examination Report—App. No. 3122967.

* cited by examiner

CLOSURE AND LID AND METHOD OF FORMING CLOSURE AND LID

CROSS-REFERENCE TO RELATED APPLICATIONS

This application is a U.S. National Stage application under 35 U.S.C. § 371 of International Application PCT/US2019/057420, filed Oct. 22, 2019, which claims priority to U.S. Provisional Patent Application No. 62/749,443 filed Oct. 23, 2018, and entitled "CLOSURE AND LID AND METHOD OF FORMING CLOSURE AND LID," each of which is incorporated herein by reference in its entirety for any and all non-limiting purposes.

FIELD

The present disclosure herein relates broadly to lids for drinkware, and more specifically to closeable lids for drinkware containers used for drinkable beverages or foods.

BACKGROUND

Beverage containers can be filled with hot or cold drinkable liquids, such as water, coffee, tea, soft drink, or alcoholic beverage, such as beer. These beverage containers can be made of a variety of materials such as stainless steel, glass, plastic, cardboard, or paper material. Lids may be provided on beverage containers to provide an opening for pouring out the contents of the beverage container. In certain instances, it can be desired to selectively close and store the container such that the contents of the container do not spill.

SUMMARY

This Summary provides an introduction to some general concepts relating to this invention in a simplified form that are further described below in the Detailed Description. This Summary is not intended to identify key features or essential features of the invention.

Aspects of the disclosure herein may relate to a closable lid assembly for drinkware. In one example, the lid assembly can include a manually movable slider, which may include a tab or handle. In certain examples, the slider can be configured to perform one or more of the following: slide between a closed position and an open position where the slider covers an opening to aid in preventing spilling of contents of the container and an opened position where the slider uncovers the opening such that the contents of the container can be consumed, remain secured to the lid during movement between the closed position and the opened position, and to be removable from the lid so that the lid and slider can be cleaned.

BRIEF DESCRIPTION OF THE DRAWINGS

The foregoing Summary, as well as the following Detailed Description, will be better understood when considered in conjunction with the accompanying drawings in which like reference numerals refer to the same or similar elements in all of the various views in which that reference number appears.

DETAILED DESCRIPTION

In the following description of the various examples and components of this disclosure, reference is made to the accompanying drawings, which form a part hereof, and in which are shown by way of illustration various example structures and environments in which aspects of the disclosure may be practiced. It is to be understood that other structures and environments may be utilized and that structural and functional modifications may be made from the specifically described structures and methods without departing from the scope of the present disclosure.

Also, while the terms "frontside," "backside," "top," "base," "bottom," "side," "forward," and "rearward" and the like may be used in this specification to describe various example features and elements, these terms are used herein as a matter of convenience, e.g., based on the example orientations shown in the figures and/or the orientations in typical use. Nothing in this specification should be construed as requiring a specific three dimensional or spatial orientation of structures in order to fall within the scope of the claims.

Figure 1:
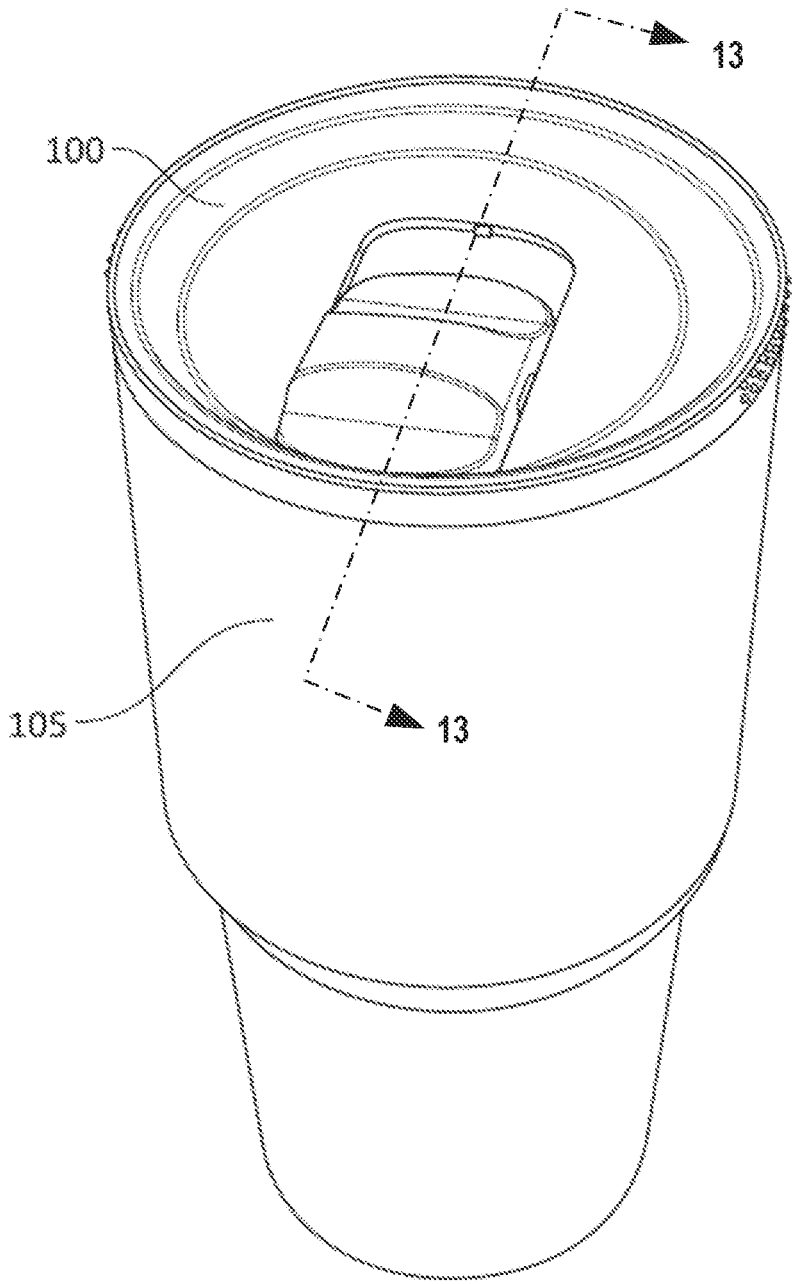
FIG. 1 depicts an isometric view of a lid assembly that is removably coupled to a container, according to one or more aspects described herein.

FIG. 1 depicts an isometric view of a lid assembly 100 that is removably coupled to a container 105, according to one or more aspects described herein. Container 105 is one example container to which the lid assembly 100 may be configured to be removably coupled. Accordingly, the container 105 may be configured to store a volume of liquid and the lid assembly 100 may be configured to seal an opening of the container 105.

Figure 2B:
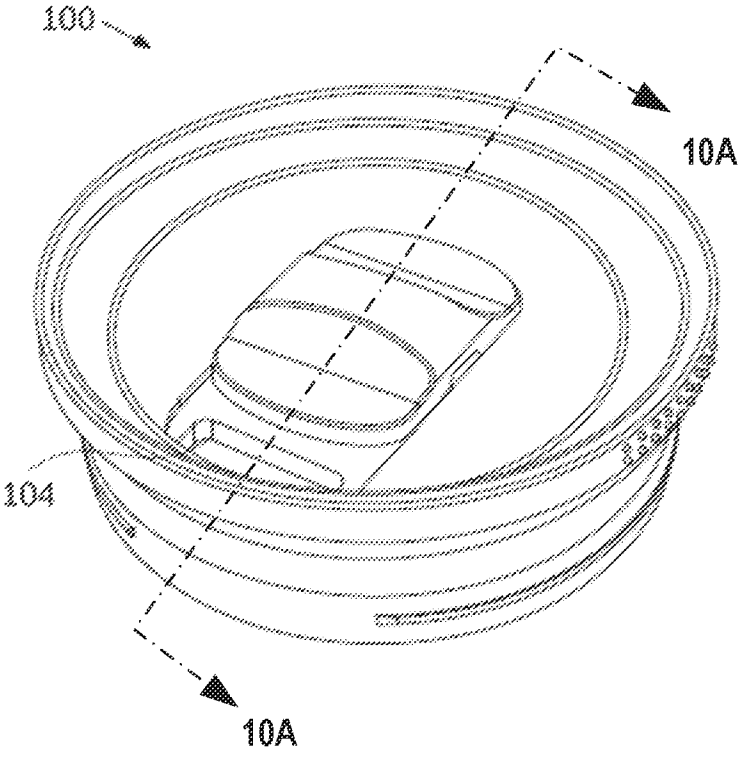
FIGS. 2A and 2B depict isometric views of a lid assembly in a closed and an open configuration, respectively, according to one or more aspects described herein.
Figure 2A:
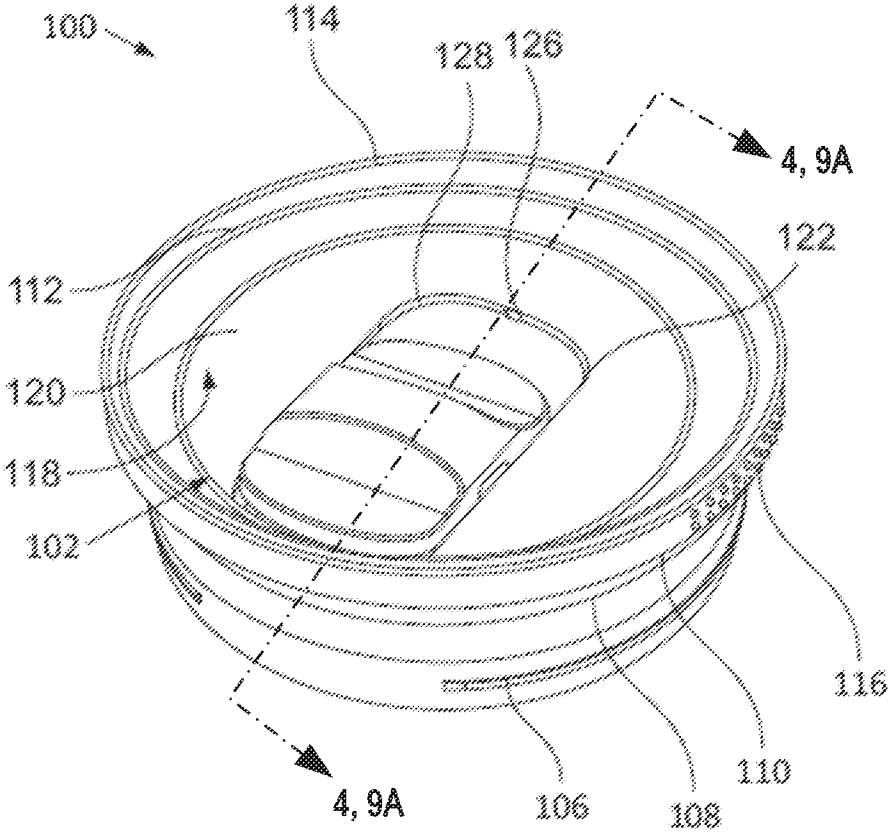

FIGS. 2A and 2B depict isometric views of the lid assembly 100 in a closed and an open configuration, respectively. The lid assembly 100 generally includes a slider mechanism 102 that is configured to move between a closed position (depicted in FIG. 2A) and an open position (depicted in FIG. 2B) to selectively close or open a first opening 104 through which a liquid, stored in the container 105, is configured to flow. Further details of the slider mechanism 102 are discussed in relation to the proceeding figures. The lid assembly 100 may additionally include a side wall 106, which can define a groove 108 for placement of a gasket 110. Accordingly, the gasket 110 may provide a seal between the lid assembly 100 and the container 105. However, other sealing methods for sealing the lid assembly 100 to the container 105 are also contemplated. The lid assembly 100 may also include a rim 112 for engaging an opening of the container 105. The rim 112 may also include a top wall 114 and grip elements 116 and/or an optional lid tab (not depicted) extending from the top wall 114 to assist the user in removing the lid assembly 100 from the container 105.

The lid assembly 100 may also include a middle wall 118 extending below the rim 112. A top surface 120 of the middle wall 118 can define a recess 122 for receiving the slider mechanism 102. In one example, the recess 122 can define a guide channel as the slider mechanism 102 moves between the closed position depicted in FIG. 2A and the open position depicted in FIG. 2B. As shown in FIG. 2B, the first opening 104 for drinking or pouring liquid out of the container can also be formed in the recess 122. The recess 122 can also include a second opening 124, which is described in further detail in relation to FIG. 5A. A detent 126 may extend into from the top surface 120 of the middle wall 118 into the recess 122. This detent 126 may be configured to abut the slider mechanism 102 when in the open position depicted in FIG. 2B to prevent liquid from being compressed between the slider mechanism 102 and an end wall 128 of the recess 122, which may otherwise result in splashing of a liquid that may pool in the recess 122 as a result of a user drinking or pouring from the first opening 104.

Figure 3:
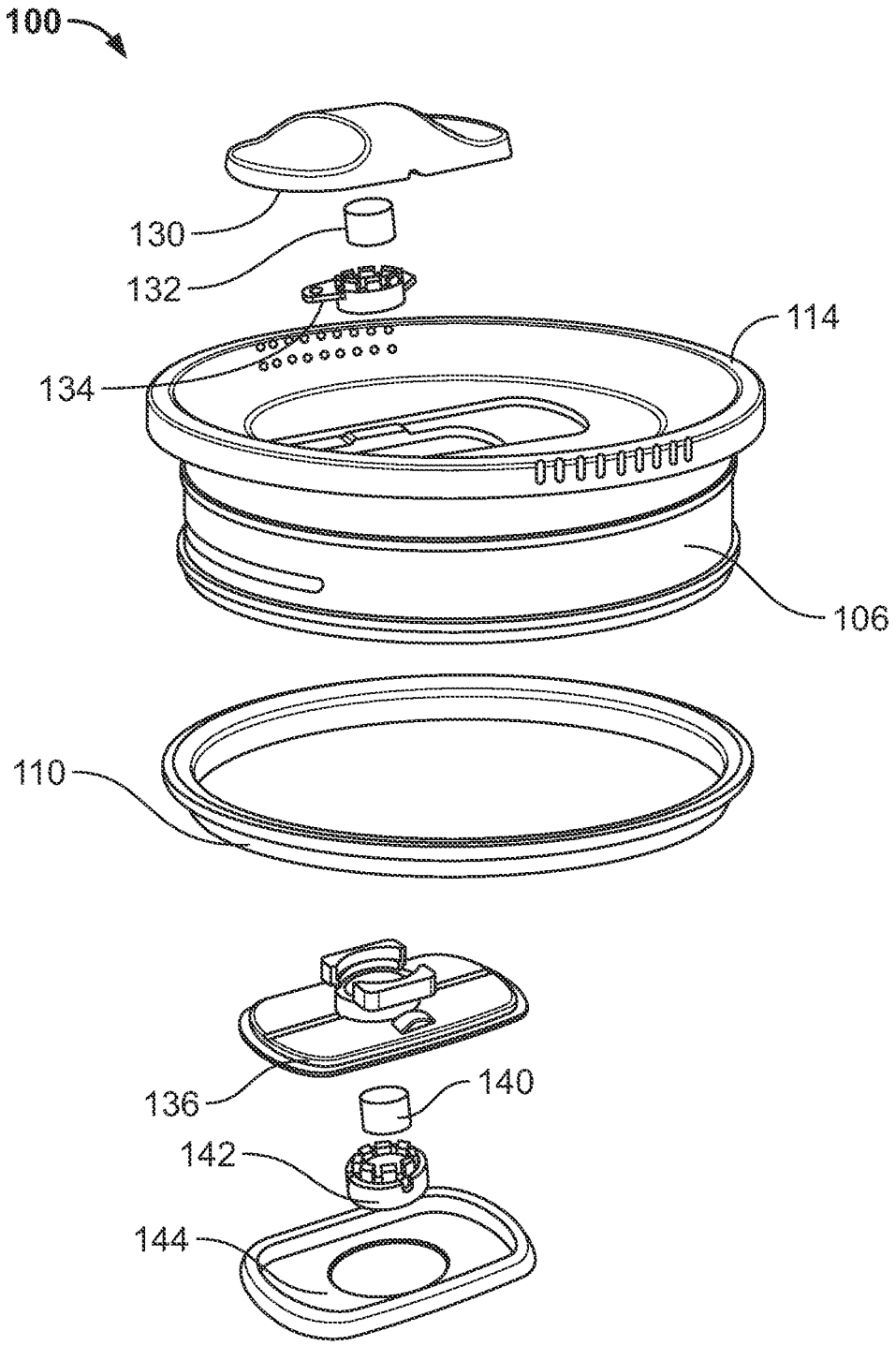
FIG. 3 schematically depicts an exploded isometric view of a lid assembly, according to one or more aspects described herein.

FIG. 3 schematically depicts an exploded isometric view of the lid assembly 100, according to one or more aspects described herein. In particular, FIG. 3 schematically depicts multiple elements that make up the slider mechanism 102, as discussed in relation to FIGS. 2A and 2B. Accordingly, the slider mechanism 102 may include an upper sled 130, which is configured to be positioned within the recess 122 on the top surface 120 of the middle wall 118. The upper sled 130 may include an upper sled magnet 132 that is encapsulated therein. In one example, the upper sled magnet 132 may be encapsulated within a cavity in the upper sled 130, and may be overmolded with a polymeric overmold plug element 134. Additional or alternative encapsulation methods may be used to secure the upper sled magnet 132 within the upper sled 130, without departing from the scope of these disclosures. Additionally, the upper sled magnet 132 may be formed of any suitable ferromagnetic or otherwise magnetic material. The upper sled 130 is discussed in further detail in relation to FIGS. 7A and 7B.

Figure 5B:
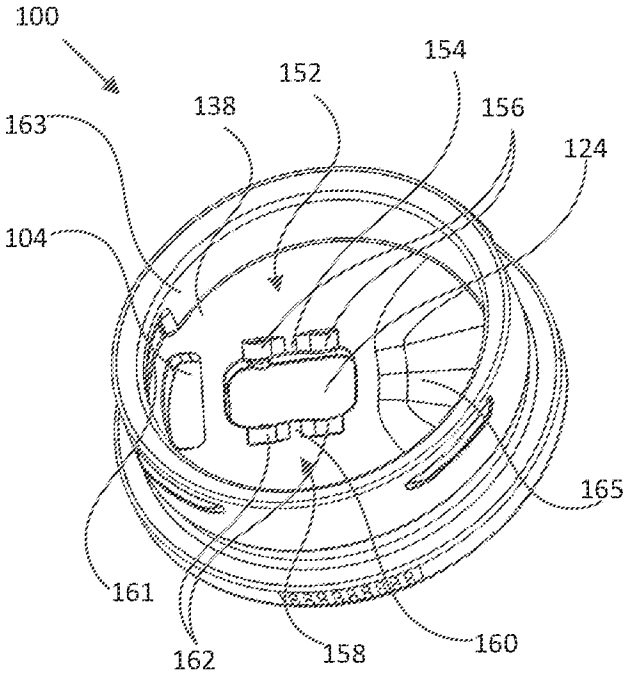
FIGS. 5A and 5B depict isometric views of a lid assembly without a slider mechanism come according to one or more aspects described herein.

The slider mechanism 102 may additionally include a lower sled 136 that is configured to be positioned adjacent to a bottom surface 138 of the middle wall 118 (depicted in FIG. 5B). The lower sled 136 may include a lower sled magnet 140 that is encapsulated therein. In one example, the lower sled magnet 140 may be encapsulated within a cavity in the lower sled 136, and may be overmolded with a polymeric overmold plug element 142. Additionally, the slider mechanism 102 may include a lower gasket 144 that is configured to extend around a perimeter of the lower sled 136. The lower sled 136 is described in further detail in relation to FIGS. 6A and 6B.

In one example, magnetic attraction between the upper sled magnet 132 and the lower sled magnet 140 magnetically couples the upper sled 130 to the lower sled 136 across the middle wall 118. Accordingly, manual actuation of the upper sled 130 on the top surface 6 of the middle wall 118 results in sliding motion of both the upper sled 130 and the lower sled 136.

Figure 4:
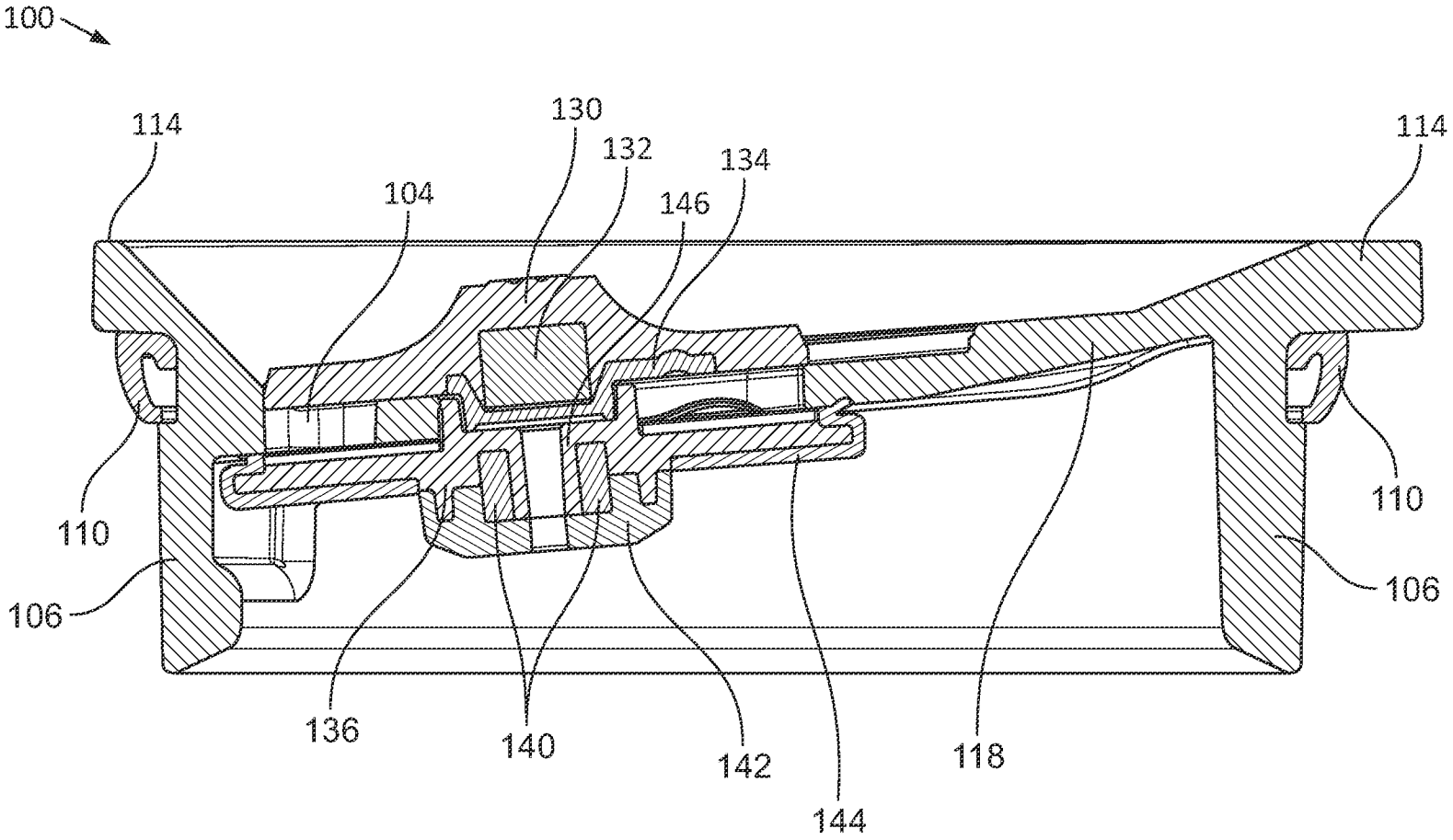
FIG. 4 schematically depicts a cross-sectional view through a lid assembly 100 along line 4-4, according to one or more aspects described herein.

FIG. 4 schematically depicts a cross-sectional view through the lid assembly 100, according to one or more aspects described herein. As depicted, the slider mechanism 102 is in a closed configuration such that the first opening 104 is sealed by the slider mechanism 102. In one example, the lower sled magnet 140 may have a cylindrical geometry with a hollow center. As such, the lower sled magnet 140 may otherwise be described as a ring magnet that extends around a central tube 146 through the overmolded plug element 142 and the lower sled 136. In another example, the the lower sled magnet 140 may have a solid cylindrical geometry.

Figure 5A:
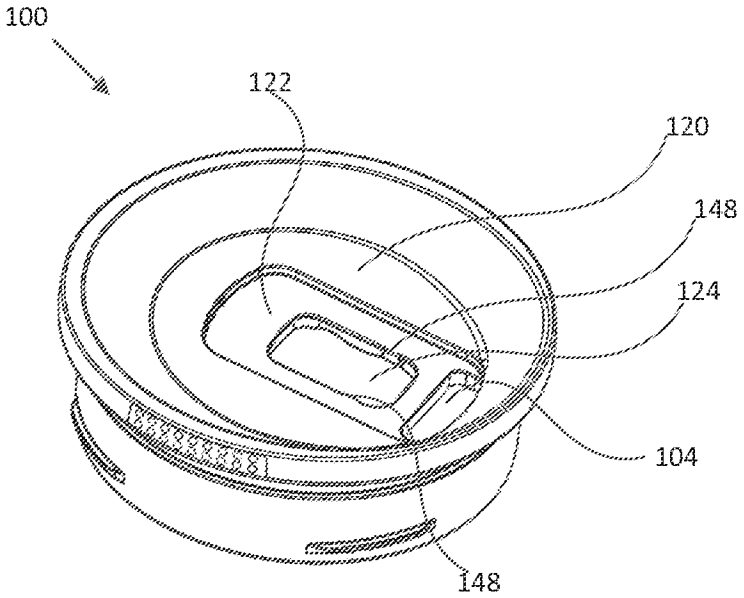

FIGS. 5A and 5B depict isometric views of the lid assembly 100 without the slider mechanism 102. In particular, FIG. 5A depicts a view of the top surface 120 of the middle wall 118, and FIG. 5B depicts a view of the bottom surface 138 of the middle wall 118. As depicted, the lid mechanism 100 includes a first opening 104 and a second opening 124. In one example, a portion of the slider mechanism 102 is configured to extend through the second opening 124 when the upper sled 130 is magnetically coupled to the lower sled 136.

The second opening 124 may include detents 148 that extend from the middle wall 118 into the second opening 124. These detents 148 are configured to be received into channels 150 (see FIG. 6A) extending along a portion of the central tube 146 of the lower sled 136 when the slider mechanism 102 is in the closed position depicted in FIG. 2A. Accordingly, the detents 148 are configured to provide an interference fitting to prevent the slider mechanism 102 from being inadvertently moved and thereby inadvertently unseal the first opening 104. In one example, the slider mechanism 102 may be configured to lock in the open and/or closed configuration depicted in FIGS. 2A and 2B. It is further contemplated that a locking mechanism in addition to the detents 148 may be used to further prevent the slider mechanism 102 from being inadvertently moved.

FIG. 5B depicts the bottom surface 138 of the middle wall 118. Accordingly, as depicted, the bottom surface 138 defines a first ramped feature 152 on a first side of the second opening 124. The first ramped feature 152 having a crest surface 154 spaced between two trough depressions 156. Similarly, a second ramped feature 158 is positioned on a second side of the second opening 124. The second ramped feature 158 includes a crest surface 160 spaced between two trough depressions 162.

The lid assembly 100 additionally includes a recess pocket 161 extending into an inner surface 163 of the sidewall that extends below the bottom surface 138 of the middle wall 118. Accordingly, the recess pocket 161 receives a portion of the lower sled 136 when the slider mechanism 102 is in the closed position depicted in FIG. 2A.

The lid assembly 100 also includes a recessed vent pocket 165, such that the geometry of the recessed vent pocket 165 allows air to flow into the container 105 as a liquid is being poured out of the first opening 104.

Figure 6B:
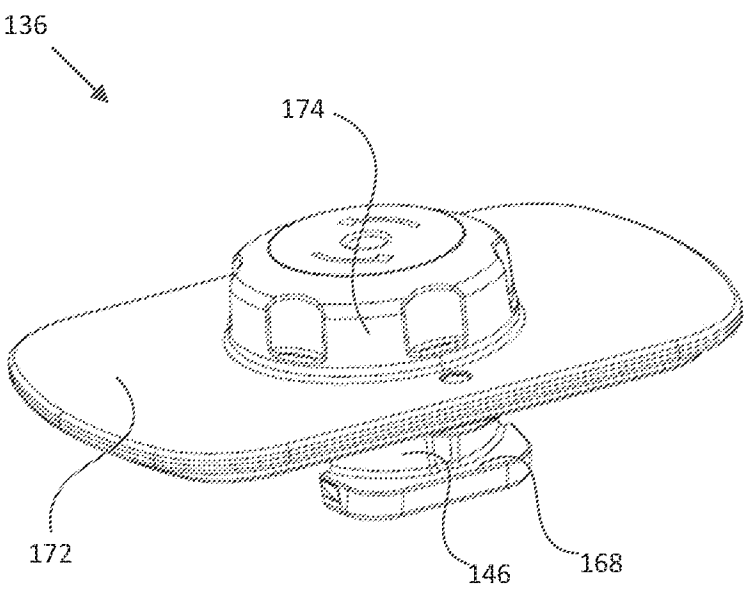
FIGS. 6A and 6B depict isometric views of a lower sled, according to one or more aspects described herein.
Figure 6A:
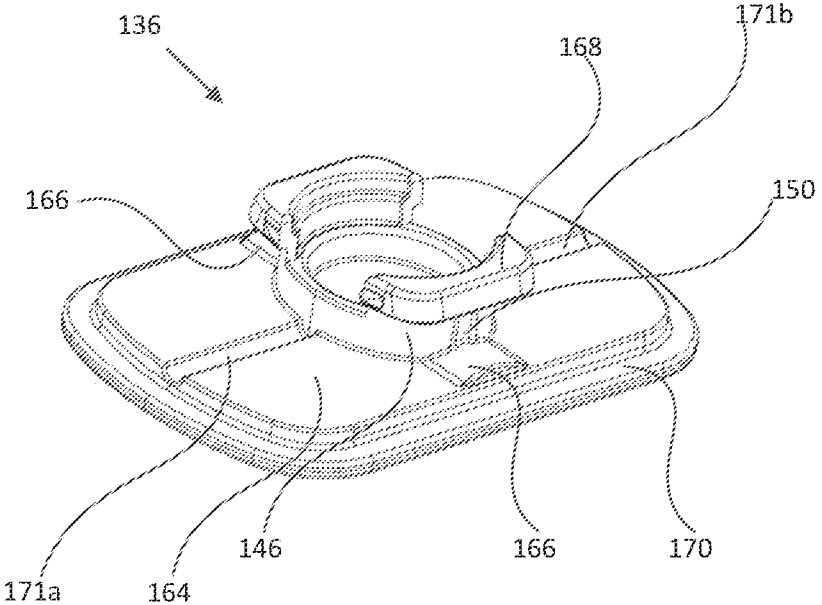

FIGS. 6A and 6B depict isometric views of the lower sled 136, according to one or more aspects described herein. Accordingly, the lower sled 136 includes an inner surface 164 that is configured to be positioned adjacent to the bottom surface 138 of the middle wall 118. The inner surface 164 includes a lower sled ramp 166. The lower sled ramp 166 is configured to be received into one of the trough depressions of each of the first ramped feature 152 and the second ramped feature 158. As such, the lower sled ramp 166 is configured to slide across the first ramped feature 152 and the second ramped feature 158 as the slider mechanism 102 slides between the open and close configurations. As the slider mechanism 102 transitions between the open and the closed configuration, the lower sled ramp 166 will abut the crest surfaces 154 and 160. Further, because the crest surfaces 154 and 160 are raised relative to the trough depressions on either side of the crest surfaces 154 and 160, this will urge the upper sled 130 and the lower sled 136 to space further apart from one another. As such, because the magnetic force between the upper sled magnet 132 and the lower sled magnet 140 is inversely proportional to the square of the distance between them, the magnetic attractive force will be reduced when the lower sled ramp 166 abuts the crest surfaces 154 and 160. In one example, this reduction in magnetic force will provide for smooth movement of the slider mechanism 102 between the open and closed positions. Further, when the lower sled ramp 166 is positioned within the trough depressions of the first ramped feature 152 and the second ramped feature 158, the comparatively shorter distance between the upper sled magnet 132 and the lower sled magnet 140 will result in a comparatively stronger magnetic attractive force that serves to secure the slider mechanism 102 in the open or closed configuration.

It is noted that the lower sled 136 and the upper sled 130 are symmetrical about to perpendicular axes in order to allow the slider mechanism to be installed in the lid assembly 100 in any of four different ways. The lower sled 136 additionally includes a central tube 146 that extends from the inner surface 164. Further, the central tube 146 includes tab ears 168 that are configured to extend through the second opening 124. The lower sled 136 further includes a channel 170 that is configured to receive a portion of the lower gasket 144. Additionally, the lower sled 136 includes lower vent channels 171*a* and 171*b*. Accordingly, when the slider mechanism 102 is in the open configuration, a portion of the lower sled 136 extends over a portion of the recessed vent pocket 165. Further, one of the lower vent channels 171*a* or 171*b* is positioned over the recessed vent pocket 165, and thereby sets up a channel by which air can pass from the slider mechanism 102 into an internal cavity of the container 105.

FIG. 6B depicts an isometric view of an outer surface 172 of the lower sled 136. In one example, a knob 174, otherwise referred to as finger tabs 174 extend from the outer surface 172. This knob 174 is configured to be gripped by a user in order to install the slider mechanism 102 in the lid assembly 100. This installation process is described in further detail in relation to FIG. 12.

Figure 7B:
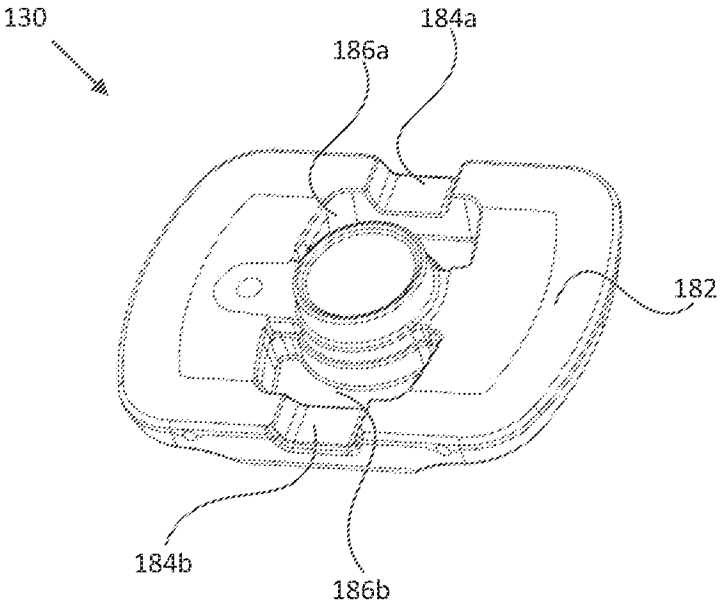
FIGS. 7A and 7B depict isometric views of an upper sled, according to one or more aspects described herein.
Figure 7A:
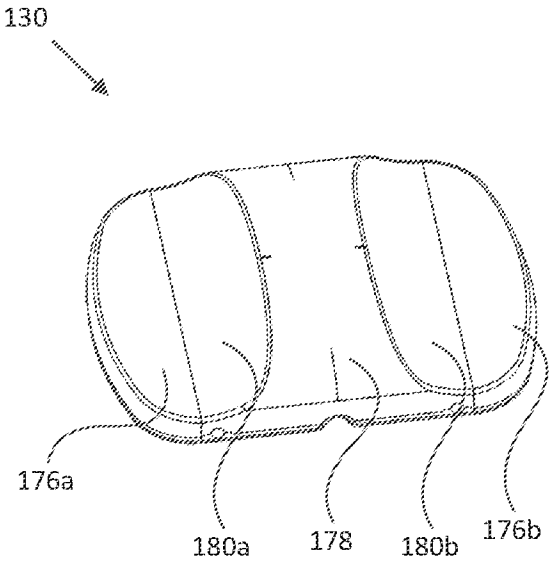

FIGS. 7A and 7B depict isometric views of the upper sled 130. The upper sled 130 can include two symmetrical flanges 176*a* and 176*b*, which are both configured to selectively cover and seal the first opening 104 for pouring liquid out of the container and the second opening 124 in the recess 122, otherwise referred to as a guide channel 122. The tab or the handle 178 is configured for the user to grasp to selectively move the upper sled 130, and thereby the slider mechanism 102, into an opened position to uncover the first opening 104 on the lid assembly 100 or closed position to cover the first opening 104 on the lid assembly 100. The tab or handle 178 may include two inwardly tapered portions 180*a* and 180*b* for grasping purposes.

FIG. 7B depicts a view of an inner side 182 of the upper sled 130. Accordingly, the upper sled 130 includes upper vent channels 184*a* and 184*b*. Accordingly, when the slider mechanism 102 is in the open configuration, a vent path is partially formed by a portion of the lower sled 136 extending over a portion of the recessed vent pocket 165. Additionally, one of the lower vent channels 171*a* or 171*b* is positioned over the recessed vent pocket 165, and thereby sets up a channel through which air can pass from the slider mechanism 102 into an internal cavity of the container 105. This vent path between an external environment and the internal cavity of the container 105 is completed as the upper vent channels 184*a* and 184*b* allow air to pass from the external environment into the slider mechanism 102. The upper sled recesses 186*a* and 186*b* are configured to receive a portion of the tab ears 168 of the lower sled 136.

Figure 8A:
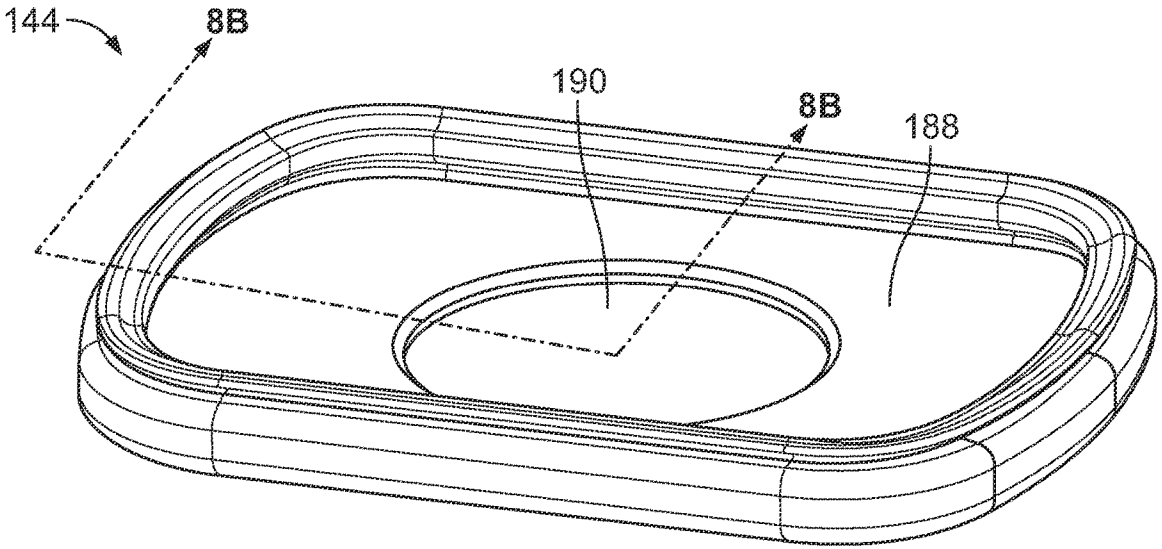
FIGS. 8A and 8B depict an isometric and a partial cross-sectional view of the lower gasket along line 8B-8B, according to one or more aspects described herein.
Figure 8B:
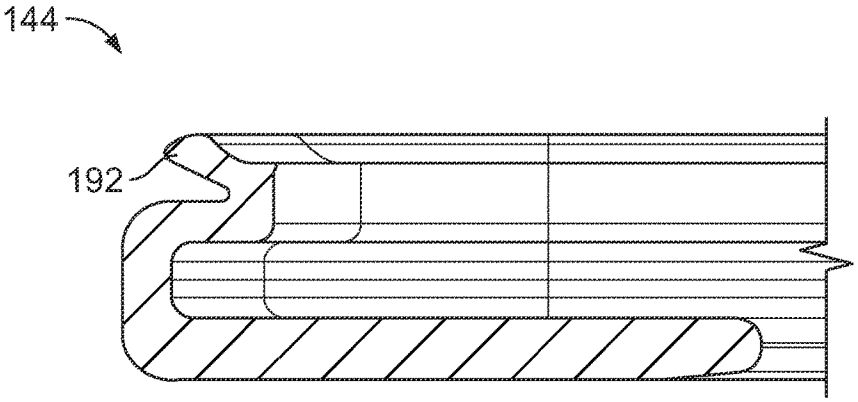

FIGS. 8A and 8B depict an isometric and a partial cross-sectional view of the lower gasket 144, according to one or more aspects described herein. Accordingly, the lower gasket 144 is configured to seal the first opening 104 when the slider mechanism 102 is in the closed configuration depicted in FIG. 2A. Additionally, the lower gasket 144 is configured to seal the second opening 124. In one example, an inner surface 188 of the lower gasket 144 is configured to be positioned over the outer surface 172 of the lower sled 136. The opening 190 in the lower gasket 144 is configured to allow the knob 174 of the lower sled 136 to extend through. In one limitation, the lower gasket 144 may be constructed from silicone. However, additional or alternative polymeric materials may be used, without departing from the scope of these disclosures.

The cross-sectional view of FIG. 8B indicates the spring feature 192 of the lower gasket 144. Accordingly, the spring feature 192 allows the seal formed by the gasket 144 to move and stay in contact with the bottom surface 138 of the middle wall 118. Accordingly, when in the open or closed configurations, the comparatively high magnetic force urging the lower sled 136 toward the bottom surface 138 of the middle wall 118 compresses the spring feature 192 of the lower gasket 144. Further, when the lower sled ramp 166 is positioned on the crest surfaces 154 and 160, and the magnetic force is comparatively lower and the lower sled 136 is moved away from the bottom surface 138, the spring feature 192 extends out toward and maintains contact with the bottom surface 138 to maintain the seal of the lower gasket 144 on the bottom surface 138.

Figure 9A:
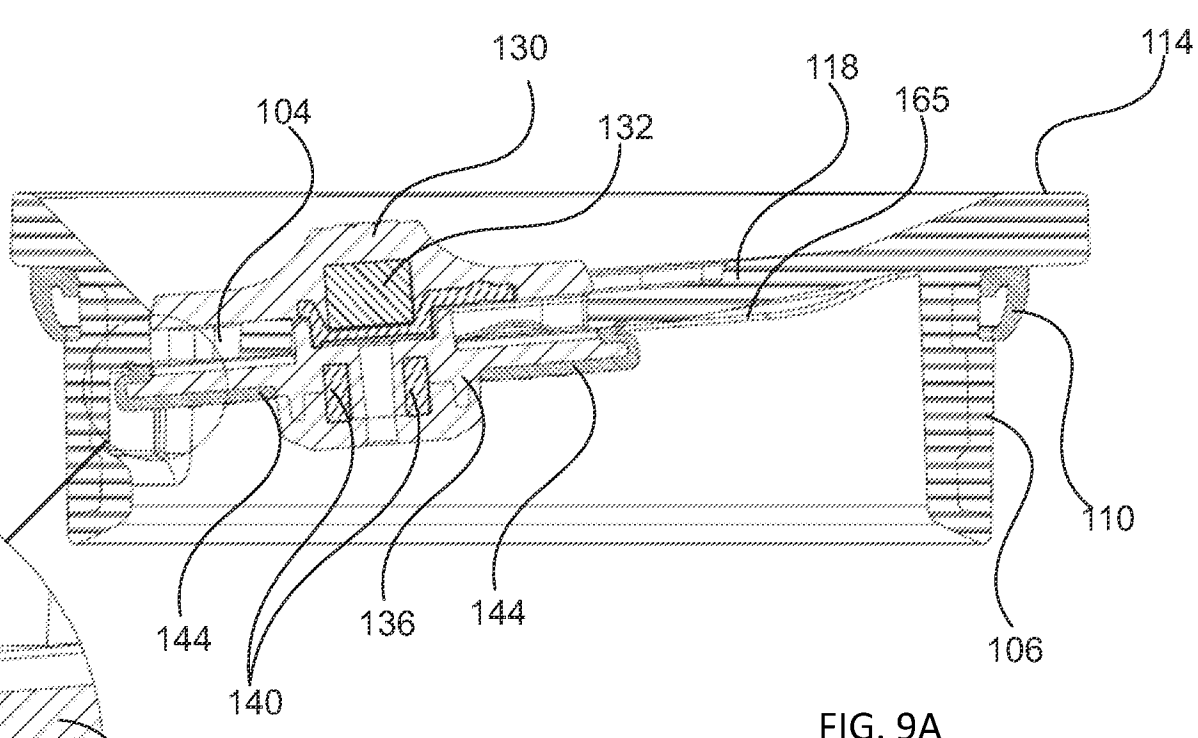
FIGS. 9A and 9B schematically depict cross-sectional views of a lid assembly in a closed configuration along line 9A-9A, according to one or more aspects described herein.
Figure 9B:
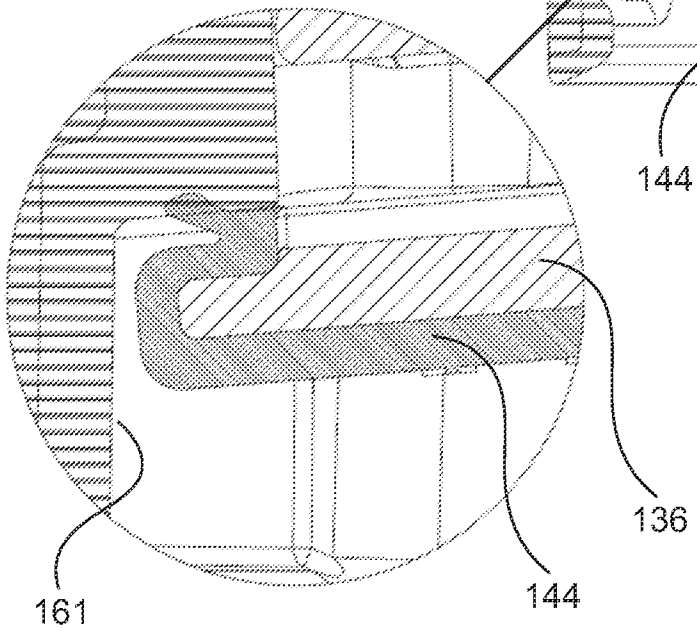

FIGS. 9A and 9B schematically depict cross-sectional views of the lid assembly 100 in a closed configuration. As depicted, the slider mechanism 102 that includes the upper sled 130 and the lower sled 136 is sealing the first opening 104. FIG. 9B depicts a more detailed view of a portion of the cross-section of FIG. 9A. Accordingly, FIG. 9B depicts a portion of the lower sled 136 and the lower gasket 144 received into the recess pocket 161 of the lid assembly 100.

Figures 10A, 10B:
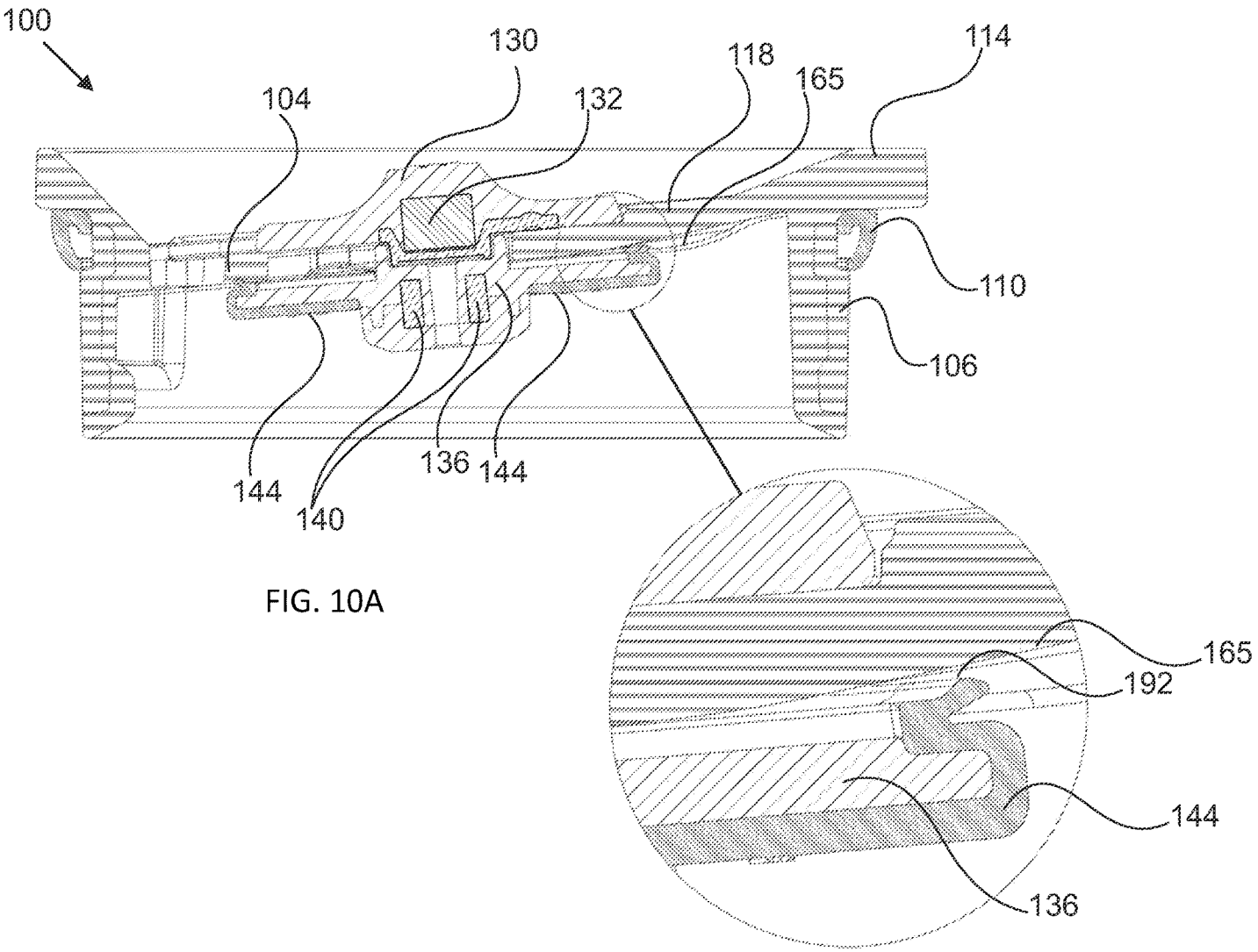
FIGS. 10A and 10B schematically depict cross-sectional views of a lid assembly in an open configuration along line 10A-10A, according to one or more aspects described herein.

FIGS. 10A and 10B schematically depict cross-sectional views of the lid assembly 100 in an open configuration. As depicted, the first opening 104 is completely uncovered by the slider mechanism 102 that includes the upper sled 130 and the lower side 136. FIG. 10B schematically depicts a more detailed view of a portion of the cross-section of FIG. 10A. In particular, FIG. 10B depicts a portion of the lower gasket 144 that has been slid over a portion of the recessed vent pocket 165. The overlap of the portion of the lower gasket 144 on the portion of the recessed vent pocket 165 results in a gap 194 through which the air can enter into the container 105 as liquid is being poured from the first opening 104.

Figures 11A, 11B:
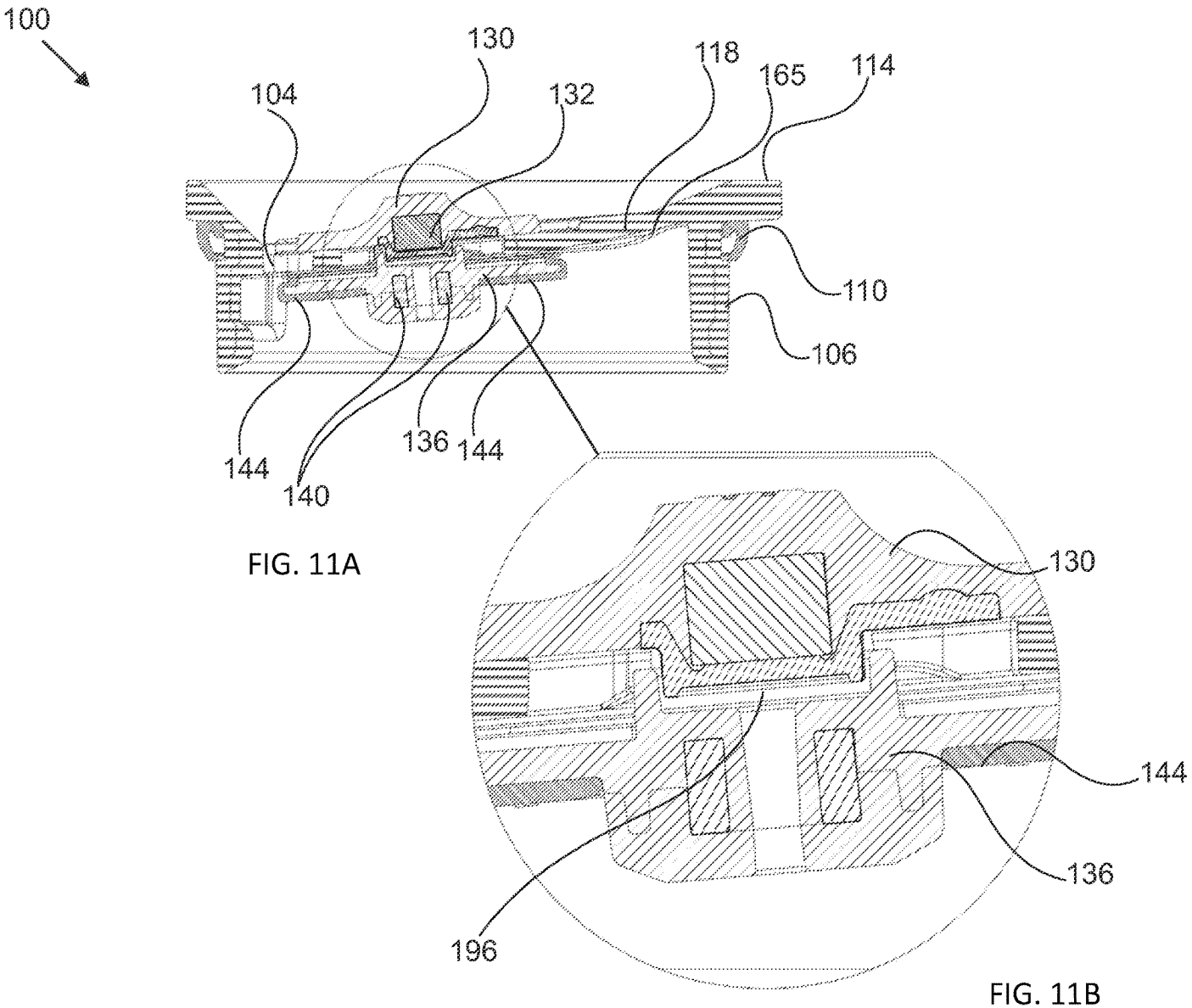
FIGS. 11A and 11B schematically depict cross-sectional views of a lid assembly in a partially-open configuration along the same plane as FIG. 10A, according to one or more aspects described herein.

FIGS. 11A and 11B schematically depict cross-sectional views of the lid assembly 100 in a partially-open configuration. As depicted, the first opening 104 is partially uncovered by the slider mechanism 102 that includes the upper sled 130 and the lower sled 136. FIG. 11B schematically depicts a more detailed view of a portion of the cross-section of FIG. 11A. In particular, FIG. 11B depicts a separation 196, or gap 196 between the upper sled 130 and the lower sled 136. This separation 196 results from the lower sled ramp 166 abutting the crest surfaces 154 and 160, as previously described.

Figures 12A, 12B, 12C, 12D:
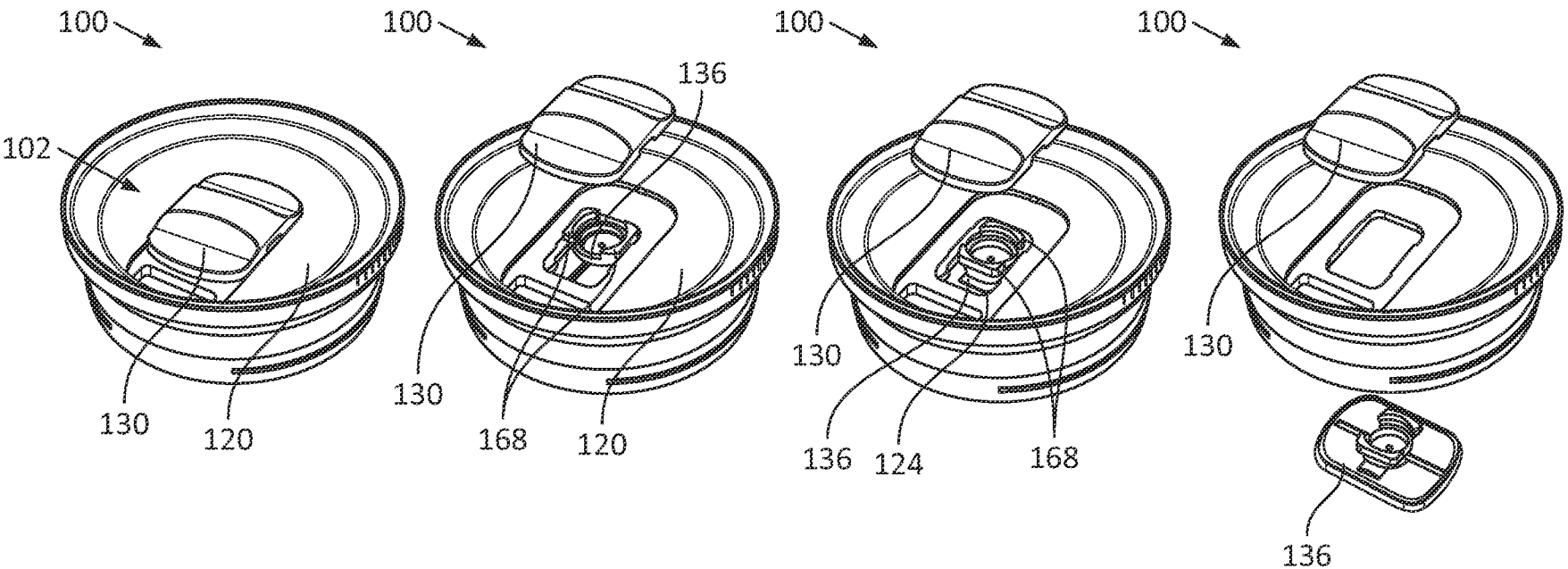
FIGS. 12A-12D depict various steps for disassembly of a slider mechanism and removal from a lid assembly, according to one or more aspects described herein.

FIGS. 12A-12D depict various steps for disassembly of the slider mechanism 102 and removal from the lid assembly 100. As previously described, the slider mechanism 102 includes the upper sled 130 and the lower sled 136. Further, the upper sled includes the upper sled magnet 132, and the lower sled 136 includes the lower sled magnet 140 and lower gasket 144. FIG. 12A depicts the lid assembly 100 with the slider mechanism 102 fully installed and in an open configuration. In order to remove the slider mechanism, for example to facilitate cleaning of the lid assembly 100, the upper sled 130 may be manually lifted from the top surface 120. FIG. 12B depicts the upper sled 130 after having being removed from the top surface 120. Once the upper sled 130 is removed, the lower sled 136 is no longer held against the bottom surface 138 by the magnetic attractive force between the upper sled magnet 132 and the lower sled magnet 140. However, tab ears 168 prevent the lower sled 136 from falling into the container 105 as the tab ears 168 extend through the second opening 124 and grip onto a portion of the top surface 120.

In order to remove the lower sled 136 from the lid assembly 100, the lower sled 136 is rotated through 90° such that the tab ears 168 can be passed through the second opening 124. FIG. 12D depicts the upper sled 130 and lower sled 136 fully removed from the lid assembly 100.

Figure 13:
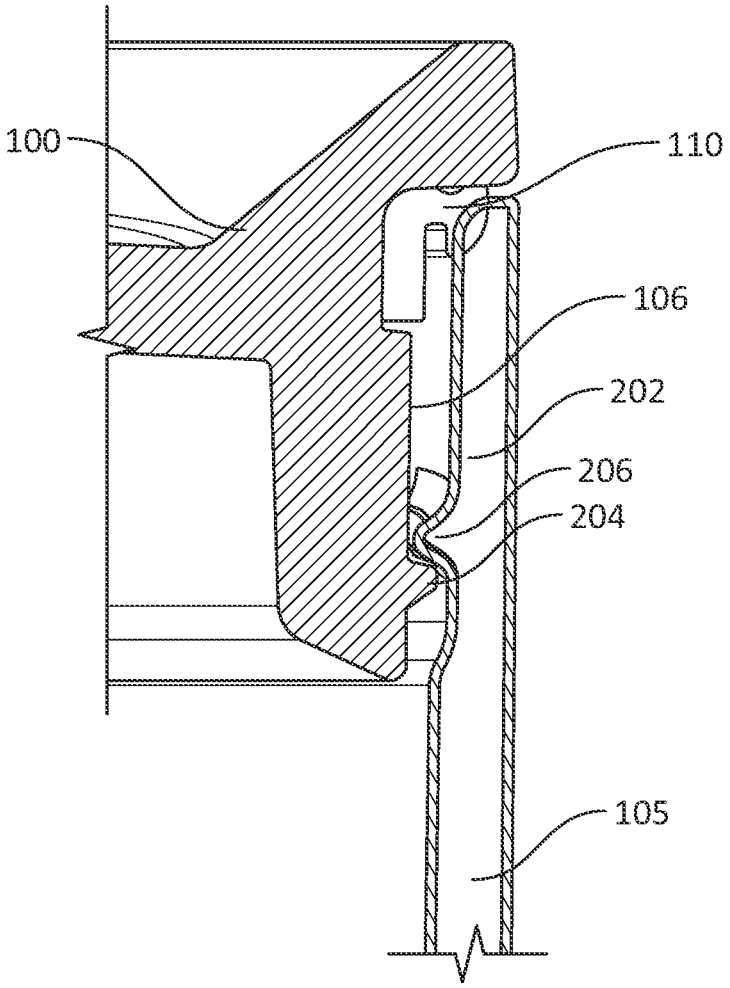
FIG. 13 schematically depicts a cross-sectional view of a portion of a lid assembly coupled to a container along line 13-13, according to one or more aspects described herein.

FIG. 13 schematically depicts a cross-sectional view of a portion of the lid assembly 100 coupled to a container 105. In one example, the lid assembly 100 may be resealably coupled to the container 105 by threaded elements on both the side wall 106 of the lid assembly 100, and a side wall 202 of the container 105. Elements 204 and 206 are threads on the sidewalls 106 and 202, respectively. Further, it is contemplated that any thread geometries may be used to secure the lid assembly 100 to the container 105, without departing from the scope of these disclosures. Alternatively, the various lid assembly 100 structures described throughout this disclosure may be implemented without a threaded coupling between the lid assembly 100 and the container 105. In one example, the lid assembly 100 may be secured to the container 105 by an interference fit, among others.

Figure 14A:
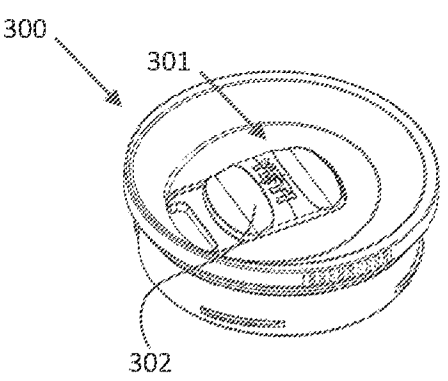
FIGS. 14A-14E depict an alternative implementation of a slider mechanism that has an alternative disassembly mechanism come according to one or more aspects described herein.
Figure 14B:
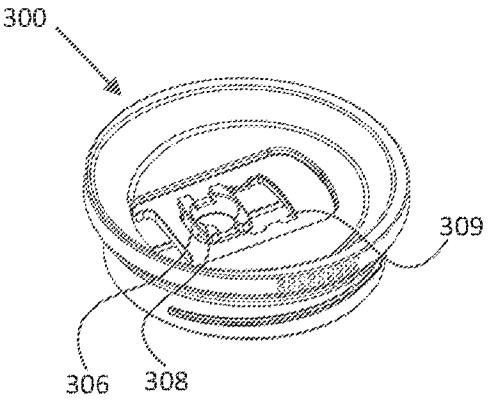
Figure 14C:
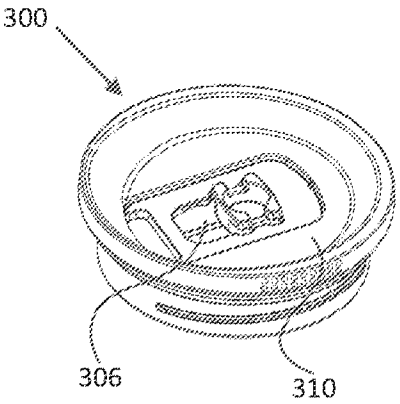
Figure 14D:
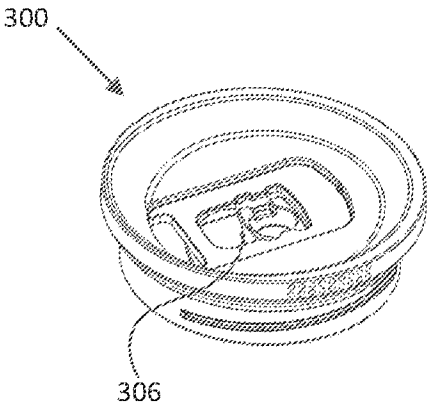
Figure 14E:
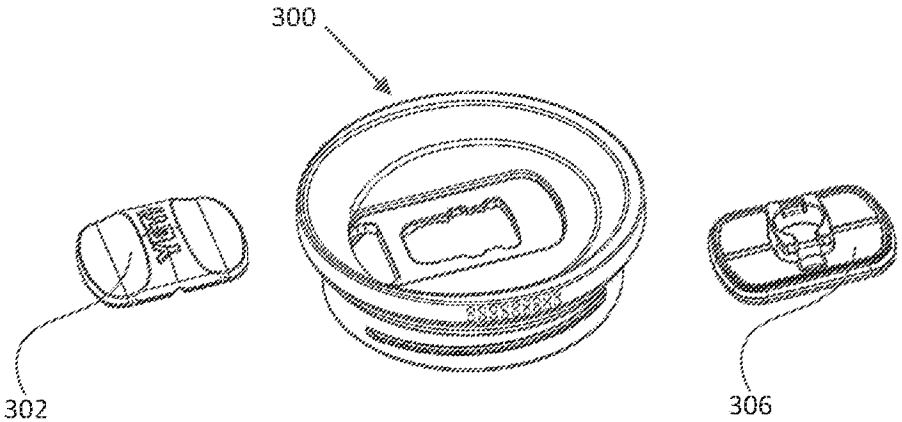

FIGS. 14A-14E depict an alternative implementation of a slider mechanism that has an alternative disassembly mechanism. Accordingly, FIG. 14A depicts an isometric view of a lid assembly 300 that includes a slider mechanism 301. The lid assembly 300 may be similar to lid assembly 100, and the slider mechanism 301 may be similar to slider mechanism 102. The slider mechanism 301 may include an upper sled 302 similar to upper sled 130, and a lower sled 306 similar to lower sled 136. In order to disassemble the slider mechanism, the upper sled 302 may be manually removed from the lid assembly 300. Similar to the lower sled 136, the lower sled 306 may include tab ears 308 to prevent the lower sled 306 from falling into the container when the upper sled 302 is removed. However, in order to remove the lower sled 306 from the lid assembly 300, the lower sled 306 is slid to the position depicted in FIG. 14C, such that the geometry of the tab ears 308 aligns with the geometry of an opening 309 in the middle wall 310 of the lid assembly 300. When positioned in the configuration depicted in FIG. 14C, the lower sled 306 can pass through the opening 309, as depicted in FIG. 14D. FIG. 14E depicts the upper sled 302 and lower sled 306 fully removed from the lid assembly 300.

In one implementation, a lid assembly may include a rim for engaging an opening of a container, with the rim defining a top wall, the lid assembly may additionally include a side wall defining a groove for placement of an upper gasket. A middle wall may extend below the rim, with a top surface of the middle wall defining a recess. The recess may have a first opening, a second opening, and an air vent. A bottom surface of the middle wall may define a first ramped feature having a crest surface spaced between two trough depressions. The first ramped feature may be positioned on a first side of the second opening, and a second ramped feature may have a crest surface spaced between two trough depressions, with the second ramped feature positioned on a second side of the second opening. The lid assembly may additionally include a slider mechanism configured to be manually slid to selectively provide a closed position, by covering both the first opening and the second opening, and an open position, by only covering the second opening. The slider mechanism may include an upper sled configured to be positioned within the recess on the top surface of the middle wall. Further, the upper sled may have an encapsulated upper sled magnet. The slider mechanism may additionally include a lower sled configured to be positioned beside the bottom surface of the middle wall. The lower sled may additionally include an inner surface that has a lower sled ramp protruding therefrom, with the lower sled ramp configured to be selectively received into a first trough depression of the two trough depressions on the first side of the second opening, and a first trough depression of the two trough depressions on the second side of the second opening, when the slider mechanism is in the open position. The lower sled ramp is additionally configured to be received into a second trough depression of the two trough depressions on the first side of the second opening and a second trough depression of the two trough depressions on the second side of the second opening when the slider mechanism is in the closed position. The lower sled may also include a lower sled magnet that is encapsulated within the lower sled. The lower sled may also have a central tube that extends from the inner surface of the lower sled and has tab ears at a distal end configured to extend through the second opening. The slider mechanism may also include a lower gasket that is configured to extend around a perimeter of the inner surface of the lower sled, and configured to be compressed between the lower sled and the lower surface of the middle wall. Further, magnetic attraction between the upper sled magnet and the lower sled magnet is configured to magnetically couple the upper sled to the lower sled.

In another example, the lower sled ramp of the lid assembly is configured to slide over the crest surfaces of the first and second ramped features as the slider mechanism slides between the open and closed positions.

In one example, the lower sled moves away from the upper sled as the lower sled ramp slides from a selected pair of the trough depressions to the crest surfaces.

In another example, the lower gasket further includes a gasket spring portion that stays in contact with the bottom surface of the middle wall of the lower sled moves away from the upper sled.

The second opening of the lid assembly further includes detents extending from the middle wall into the second opening, such that the detents are configured to be received into channels extending along a portion of the central tube, when the slider mechanism is in the closed position.

The lid assembly further includes a detent extending into the recess on the top surface of the middle wall, which is configured to abut the upper sled when in the open position to prevent liquid from being compressed between the upper sled and an end wall of the recess on the top surface of the middle wall.

The upper sled of the lid assembly may be manually removable from the lid assembly by exerting a manual force of overcome the magnetic force between the upper sled magnet and the lower sled magnet.

The tab ears of the lid assembly may be configured to catch on the sides of the second opening to prevent the lower sled from separating from the lid assembly when the upper sled is removed from the lid assembly.

The lower sled may further include finger tabs extending from an outer surface.

The lower sled of the lid assembly may be manually removable from the lid assembly by manually actuating the finger tabs to rotate the lower sled through 90° relative to the second opening in the middle wall.

The lid assembly may also have a recess pocket extending into an inner surface of the side wall that extends below the middle wall. The recess pocket may receive a portion of the lower sled when the slider mechanism is in the closed position.

The lid assembly may also include a vent pocket on the bottom surface of the middle wall, such that when the lid assembly is attached to a container and in the open position, the lower gasket slides over the vent pocket to allow air to pass between an outside atmosphere and an internal cavity of the container.

The lower sled magnet may be a ring magnet that extends around the central tube.

In another aspect, a container assembly may include a container that has an inner wall having a first end with a container opening extending into an internal reservoir, and an outer wall forming an outer shell of the container, with the outer wall having a second end configured to support the container on a surface. The container assembly may additionally include a lid adapted to seal the container opening. The lid may further include a rim for engaging the container opening, the rim defining a top wall. The lid may also have a side wall defining a groove for placement of an upper gasket, and a middle wall extending below the rim, a top surface of the middle wall defining a recess, and the recess having a first opening, a second opening, and an air vent. A bottom surface of the middle wall may define a first ramped feature that has a crest surface spaced between two trough depressions. The first ramped feature may be positioned on a first side of the second opening. A second ramped feature may have a crest surface spaced between two trough depressions, with the second ramped feature positioned on a second side of the second opening. The lid may additionally include a slider mechanism configured to manually slide to selectively provide a closed position, by covering both the first opening and the second opening, and an open position, by only covering the second opening. The slider mechanism may additionally include an upper sled configured to be positioned within the recess on the top surface of the middle wall. The upper sled may encapsulate an upper sled magnet. The slider mechanism may also include a lower sled configured to be against the bottom surface of the middle wall. The lower sled may further include an inner surface that has a protruding lower sled ramp, with the lower sled ramp configured to be selectively received into a first trough depression of the two trough depressions on the first side of the second opening and a first trough depression of the two trough depressions on the second side of the second opening when the slider mechanism is in the open position. The lower sled ramp may be configured to be received into a second trough depression of the two trough depressions on the first side of the second opening, and a second trough depression of the two trough depressions on the second side of the second opening when the slider mechanism is in the closed position. The lower sled may encapsulate a lower sled magnet. The lower sled may additionally include a central tube extending from the inner surface of the lower sled, with the central tube having tab ears connected to a distal end configured to extend through the second opening. The slider mechanism may additionally include a lower gasket that is configured to extend around a perimeter of the inner surface of the lower sled, and configured to be compressed between the lower sled and the lower surface of the middle wall. The magnetic attraction between the upper sled magnet and the lower sled magnet may magnetically couple the upper sled to the lower sled.

In one example, the inner wall of the container includes a threaded sidewall configured to receive a thread structure on the sidewall of the lid.

The container may also include a sealed vacuum cavity between the inner wall and the outer wall.

In another example, the lower sled ramp may slide over the crest surfaces of the first and second ramped features as the slider mechanism slides between the open and closed positions.

In one example, the lower sled may move away from the upper sled as the lower sled ramp slides from the selected pair of the trough depressions to the crest surfaces.

The lower gasket of the container assembly may further include a gasket spring portion that stays in contact with the bottom surface of the middle wall as the lower sled moves away from the upper sled.

The second opening of the container assembly may further include detents that extend from the middle wall into the second opening, such that the detents are configured to be received into channels extending along a portion of the central tube when the slider mechanism is in the closed position.

The container assembly may additionally include a detent that extends into the recess on the top surface of the middle wall, and configured to abut the upper sled when in the open position to prevent liquid from being compressed between the upper sled and the end wall of the recess on the top surface of the middle wall.

The upper sled may be manually removable from the lid assembly by exerting a manual force of overcome the magnetic force between the upper sled magnet and the lower sled magnet.

The upper sled of the lid assembly may be manually removable from the lid assembly by exerting a manual force of overcome the magnetic force between the upper sled magnet and the lower sled magnet.

The tab ears of the lid assembly may be configured to catch on the sides of the second opening to prevent the lower sled from separating from the lid assembly when the upper sled is removed from the lid assembly.

The lower sled may further include finger tabs extending from an outer surface.

The lower sled of the lid assembly may be manually removable from the lid assembly by manually actuating the finger tabs to rotate the lower sled through 90° relative to the second opening in the middle wall.

The container assembly may also have a recess pocket extending into an inner surface of the side wall that extends below the middle wall. The recess pocket may receive a portion of the lower sled when the slider mechanism is in the closed position.

The container assembly may also include a vent pocket on the bottom surface of the middle wall, such that when the lid assembly is attached to the container and in the open position, the lower gasket slides over the vent pocket to allow air to pass between an outside atmosphere and an internal cavity of the container.

The lower sled magnet may be a ring magnet that extends around the central tube.

In another implementation, a lid assembly may include a rim for engaging an opening of a container, and a middle wall extending below the rim, with a top surface of the middle wall having a first opening, a second opening, and an air vent. The bottom surface of the middle wall may define a first ramped feature having a crest surface spaced between two trough depressions. The first ramped feature may be positioned on a first side of the second opening. A second ramped feature may have a crest surface spaced between two trough depressions, the second ramped feature positioned on a second side of the second opening. The lid assembly may additionally include a slider mechanism configured to be manually slid to selectively provide a closed position, by covering both the first opening and the second opening, and an open position, by only covering the second opening. The slider mechanism may further include an upper sled configured to be positioned within the recess on the top surface of the middle wall, the upper sled may encapsulate an upper sled magnet. The slider mechanism may additionally include a lower sled configured to be positioned beside the bottom surface of the middle wall. The lower sled may further include an inner surface having a protruding lower sled ramp. The lower sled ramp may be configured to be selectively received into a first trough depression of the two trough depressions on the first side of the second opening, and a first trough depression of the two trough depressions on the second side of the second opening when the slider mechanism is in the open position. The lower sled ramp may be configured to be selectively received into a second trough depression of the two trough depressions on the first side of the second opening, and a second trough depression of the two trough depressions on the second side of the second opening when the slider mechanism is in the closed position. A lower sled magnet may be encapsulated within the lower sled. The slider mechanism may additionally include a lower gasket that is configured to extend around a perimeter of the inner surface of the lower sled, and configured to be compressed between the lower sled and the lower surface of the middle wall. Magnetic attraction between the upper sled magnet and the lower sled magnet may magnetically couple the lower sled to the upper sled.

In another example, a method of forming a lid assembly can include one or more of: injection molding a lid body of a first shot of material, injection molding a first plate portion of a second shot of material onto the lid body, injection molding a second plate portion of a third shot of material onto the lid body, and injection molding a seal portion with a third shot of material to seal the first plate portion and the second plate portion to the lid body. The method may further include in-molding a magnet assembly into the second plate portion. A channel can be formed between the first plate portion and the second plate portion and the second shot of material can be combined with the third shot of material. The method may also include trapping a pocket of air between the lid body and both the first plate portion and the second plate portion.

The present disclosure is disclosed above and in the accompanying drawings with reference to a variety of examples. The purpose served by the disclosure, however, is to provide examples of the various features and concepts related to the invention, not to limit the scope of the invention. One skilled in the relevant art will recognize that numerous variations and modifications may be made to the examples described above without departing from the scope of the present invention.

We claim:

1. A lid assembly comprising:

a rim for engaging an opening of a container, the rim defining a top wall;

a side wall defining a groove for placement of a first gasket;

a middle wall extending below the rim, a top surface of the middle wall defining a recess, the recess having a first opening and a second opening, a bottom surface of the middle wall defining a first ramped feature having a crest surface spaced between two trough depressions, the first ramped feature positioned on a first side of the second opening, a second ramped feature having a crest surface spaced between two trough depressions, the second ramped feature positioned on a second side of the second opening; and a slider mechanism configured to be manually slid to selectively provide a closed position, by covering both the first opening and the second opening, and an open position, by only covering the second opening, the slider mechanism comprising:

an upper sled configured to be positioned within the recess on the top surface of the middle wall, and having an upper sled magnet encapsulated therein;

a lower sled configured to be positioned proximate the bottom surface of the middle wall, the lower sled further comprising:

an inner surface having a lower sled ramp protruding there from, the lower sled ramp configured to be selectively received into a first trough depression of the two trough depressions on the first side of the second opening, and a first trough depression of the two trough depressions on the second side of the second opening when the slider mechanism is in the open position, and received into a second trough depression of the two trough depressions on the first side of the second opening, and a second trough depression of the two trough depressions on the second side of the second opening when the slider mechanism is in the closed position, a lower sled magnet encapsulated within the lower sled;

a central tube extending from the inner surface of the lower sled, and having tab ears at a distal end configured to extend through the second opening;

a second gasket, configured to extend around a perimeter of the inner surface of the lower sled, and configured to be compressed between the lower sled and the bottom surface of the middle wall, wherein magnetic attraction between the upper sled magnet and the lower sled magnet magnetically couples the upper sled to the lower sled.

2. The lid assembly of claim 1, wherein the lower sled ramp slides over the crest surfaces of the first and second ramped features as the slider mechanism slides between the open and closed positions.

3. The lid assembly of claim 2, wherein the lower sled moves away from the upper sled as the lower sled ramp slides from a selected pair of the trough depressions to the crest surfaces.

4. The lid assembly of claim 3, wherein the second gasket further comprises a gasket spring portion that stays in contact with the bottom surface of the middle wall as the lower sled moves away from the upper sled.

5. The lid assembly of claim 1, wherein the second opening further comprises detents extending from the middle wall into the second opening, wherein the detents are configured to be received into channels extending along a portion of the central tube when the slider mechanism is in the closed position.

6. The lid assembly of claim 1, further comprising a detent extending into the recess on the top surface of the middle wall, configured to abut the upper sled when in the open position to prevent liquid from being compressed between the upper sled and an end wall of the recess on the top surface of the middle wall.

7. The lid assembly of claim 1, wherein the upper sled is manually removable from the lid assembly by exerting a manual force of overcome the magnetic attraction between the upper sled magnet and the lower sled magnet.

8. The lid assembly of claim 7, wherein the tab ears are configured to catch on the sides of the second opening to prevent the lower sled from separating from the lid assembly when the upper sled is removed from the lid assembly.

9. The lid assembly of claim 1, wherein the lower sled further comprises finger tabs extending from an outer surface.

10. The lid assembly of claim 9, wherein the lower sled is manually removable from the lid assembly by manually actuating the finger tabs to rotate the lower sled through 90 degrees relative to the second opening in the middle wall.

11. The lid assembly of claim 1, further comprising a recess pocket extending into an inner surface of the side wall that extends below the middle wall, wherein the recess pocket receives a portion of the lower sled when the slider mechanism is in the closed position.

12. The lid assembly of claim 1, further comprising a vent pocket on the bottom surface of the middle wall, wherein when the lid assembly is attached to a container and in the open position, the second gasket slides over the vent pocket to allow air to pass between an outside atmosphere and an internal cavity of the container.

13. A container assembly, comprising:

a container comprising:

an inner wall having a first end with a container opening extending into an internal reservoir;

an outer wall forming an outer shell of the container, the outer wall having a second end configured to support the container on a surface;

a lid adapted to seal the container opening, further comprising:

a rim for engaging the container opening, the rim defining a top wall;

a side wall defining a groove for placement of a first gasket;

a middle wall extending below the rim, a top surface of the middle wall defining a recess, the recess having a first opening and a second opening, a bottom surface of the middle wall defining a first ramped feature having a crest surface spaced between two trough depressions, the first ramped feature positioned on a first side of the second opening, a second ramped feature having a crest surface spaced between two trough depressions, the second ramped feature positioned on a second side of the second opening; and a slider mechanism configured to be manually slid to selectively provide a closed position, by covering both the first opening and the second opening, and an open position, by only covering the second opening, the slider mechanism comprising:

an upper sled configured to be positioned within the recess on the top surface of the middle wall, and having an upper sled magnet encapsulated therein;

a lower sled configured to be positioned proximate the bottom surface of the middle wall, the lower sled further comprising:

an inner surface having a lower sled ramp protruding therefrom, the lower sled ramp configured to be selectively received into a first trough depression of the two trough depressions on the first side of the second opening, and a first trough depression of the two trough depressions on the second side of the second opening when the slider mechanism is in the open position, and received into a second trough depression of the two trough depressions on the first side of the second opening, and a second trough depression of the two trough depressions on the second side of the second opening when the slider mechanism is in the closed position, a lower sled magnet encapsulated within the lower sled; and a central tube extending from the inner surface of the lower sled, and having tab ears at a distal end configured to extend through the second opening;

a second gasket, configured to extend around a perimeter of the inner surface of the lower sled, and configured to be compressed between the lower sled and the bottom surface of the middle wall, wherein magnetic attraction between the upper sled magnet and the lower sled magnet magnetically couples the upper sled to the lower sled.

14. The container assembly of claim 13, wherein the inner wall of the container comprises a threaded sidewall configured to receive a thread structure on the side wall of the lid.

15. The container assembly of claim 13, wherein the container further comprises a sealed vacuum cavity between the inner wall and the outer wall.

16. The container assembly of claim 13, wherein the lower sled ramp slides over the crest surfaces of the first and second ramped features as the slider mechanism slides between the open and closed positions.

17. The container assembly of claim 16, wherein the lower sled moves away from the upper sled as the lower sled ramp slides from a selected two of the trough depressions to the crest surfaces.

18. The container assembly of claim 17, wherein the second gasket further comprises a gasket spring portion that stays in contact with the bottom surface of the middle wall as the lower sled moves away from the upper sled.

19. The container assembly of claim 13, wherein the second opening further comprises detents extending from the middle wall into the second opening, wherein the detents are configured to be received into channels extending along a portion of the central tube when the slider mechanism is in the closed position.

20. The container assembly of claim 13, further comprising a detent extending into the recess on the top surface of the middle wall, configured to abut the upper sled when in the open position to prevent liquid from being compressed between the upper sled and an end wall of the recess on the top surface of the middle wall.

21. The container assembly of claim 13, wherein the upper sled is manually removable from the lid by exerting a manual force of overcome the magnetic attraction between the upper sled magnet and the lower sled magnet.

22. The container assembly of claim 21, wherein the tab ears are configured to catch on the sides of the second opening to prevent the lower sled from separating from the lid when the upper sled is removed from the lid.

23. The container assembly of claim 13, wherein the lower sled further comprises finger tabs extending from an outer surface.

24. The container assembly of claim 23, wherein the lower sled is manually removable from the lid by manually actuating the finger tabs to rotate the lower sled through 90 degrees relative to the second opening in the middle wall.

25. The container assembly of claim 13, further comprising a recess pocket extending into an inner surface of the side wall that extends below the middle wall, wherein the recess pocket receives a portion of the lower sled when the slider mechanism is in the closed position.

26. The container assembly of claim 13, further comprising a vent pocket on the bottom surface of the middle wall, wherein when the lid is attached to the container and in the open position, the second gasket slides over the vent pocket to allow air to pass between an outside atmosphere and an internal cavity of the container.

27. A lid assembly comprising:

a rim for engaging an opening of a container;

a middle wall extending below the rim, a top surface of the middle wall having a first opening and a second opening, a bottom surface of the middle wall defining a first ramped feature having a crest surface spaced between two trough depressions, the first ramped feature positioned on a first side of the second opening, a second ramped feature having a crest surface spaced between two trough depressions, the second ramped feature positioned on a second side of the second opening; and a slider mechanism configured to be manually slid to selectively provide a closed position, by covering both the first opening and the second opening, and an open position, by only covering the second opening, the slider mechanism comprising:

an upper sled configured to be positioned within a recess on the top surface of the middle wall, and having an upper sled magnet encapsulated therein;

a lower sled configured to be positioned proximate the bottom surface of the middle wall, the lower sled further comprising:

an inner surface having a lower sled ramp protruding therefrom, the lower sled ramp configured to be selectively received into a first trough depression of the two trough depressions on the first side of the second opening, and a first trough depression of the two trough depressions on the second side of the second opening when the slider mechanism is in the open position, and received into a second trough depression of the two trough depressions on the first side of the second opening, and a second trough depression of the two trough depressions on the second side of the second opening when the slider mechanism is in the closed position, a lower sled magnet encapsulated within the lower sled;

a lower gasket, configured to extend around a perimeter of the inner surface of the lower sled, and configured to be compressed between the lower sled and the bottom surface of the middle wall, wherein magnetic attraction between the upper sled magnet and the lower sled magnet magnetically couples the upper sled to the lower sled.

* * * * *